US007258300B2

(12) United States Patent
Rösch

(10) Patent No.: US 7,258,300 B2
(45) Date of Patent: Aug. 21, 2007

(54) CARRIER ELEMENT

(75) Inventor: Karl Richard Rösch, Neubrunn (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 36 days.

(21) Appl. No.: 10/514,553

(22) PCT Filed: May 26, 2003

(86) PCT No.: PCT/DE03/01694

§ 371 (c)(1),
(2), (4) Date: Nov. 30, 2004

(87) PCT Pub. No.: WO03/104118

PCT Pub. Date: Dec. 18, 2003

(65) Prior Publication Data

US 2005/0211820 A1 Sep. 29, 2005

(30) Foreign Application Priority Data

Jun. 5, 2002 (DE) ..... 102 24 839

(51) Int. Cl.
*B65H 16/10* (2006.01)

(52) U.S. Cl. ..... 242/596.7

(58) Field of Classification Search ..... 242/596.1, 242/596.5, 596.6, 596.7, 597.6, 533.7, 559, 242/564, 611

See application file for complete search history.

(56) References Cited

U.S. PATENT DOCUMENTS

| | | | | | |
|---|---|---|---|---|---|
| 1,956,429 | A | | 4/1934 | Toothaker | |
| 2,171,800 | A | | 9/1939 | Mann | |
| 3,224,702 | A | * | 12/1965 | Jones et al. | 242/545.1 |
| 4,715,553 | A | * | 12/1987 | Hatakeyama et al. | 242/573.7 |
| 4,951,894 | A | | 8/1990 | Young, Jr. et al. | |
| 5,123,604 | A | | 6/1992 | Hammer et al. | |
| 5,277,375 | A | | 1/1994 | Dearwester | |
| 5,462,241 | A | * | 10/1995 | Howden, Jr. | 242/533.7 |
| 5,531,398 | A | * | 7/1996 | Krska | 242/533.7 |
| 5,647,129 | A | * | 7/1997 | Stamper | 30/139 |
| 5,651,511 | A | * | 7/1997 | Crowley et al. | 242/420.3 |
| 5,820,069 | A | | 10/1998 | Segura Salvador et al. | |
| 6,047,915 | A | * | 4/2000 | Jaschke | 242/473.9 |
| 6,260,787 | B1 | * | 7/2001 | Michel et al. | 242/530.4 |
| 6,786,443 | B2 | * | 9/2004 | Trutschel | 242/533.7 |
| 6,796,234 | B1 | * | 9/2004 | Busshoff | 101/389.1 |
| 2002/0008173 | A1 | | 1/2002 | Burri et al. | |

FOREIGN PATENT DOCUMENTS

| | | |
|---|---|---|
| DE | 972 578 | 7/1959 |
| DE | 82 615 | 6/1971 |
| DE | 1560 365 | 6/1971 |

(Continued)

*Primary Examiner*—Patrick Mackey
*Assistant Examiner*—William E. Dondero
(74) *Attorney, Agent, or Firm*—Jones, Tullar & Cooper, PC

(57) ABSTRACT

A mandrel is utilized to support a roll of material. The mandrel includes a retaining element, which can be placed on an inner circumference of a roll of material, and at least one carrier element which transmits a torque between the mandrel and the material roll. The carrier element can be engaged with the roll of material in a non-positive manner.

24 Claims, 6 Drawing Sheets

FOREIGN PATENT DOCUMENTS

| | | |
|---|---|---|
| DE | 2 100 746 | 7/1972 |
| DE | 7317470 | 5/1973 |
| DE | 2 261 559 | 6/1974 |
| DE | 24 50 757 | 4/1976 |
| DE | 2628 788 | 3/1978 |
| DE | 28 32 361 | 1/1980 |
| DE | 40 08 204 | 9/1991 |
| DE | 40 13 092 | 9/1991 |
| DE | 100 46 164 | 4/2002 |
| DE | 101 55 133 | 5/2003 |
| EP | 0 453 800 | 10/1991 |
| EP | 1 155 987 | 11/2001 |
| GB | 2 293 225 | 9/1994 |
| SE | 139 151 | 2/1953 |
| WO | WO 02/40387 | 5/2002 |

* cited by examiner

CARRIER ELEMENT

CROSS-REFERENCE TO RELATED APPLICATIONS

This patent application is the U.S. national phase, under 35 USC 371, of PCT/DE03/01694, filed May 26, 2003; published as WO 03/104118 A2 and A3 on Dec. 18, 2003, and claiming priority to DE 102 24 839.7 filed Jun. 5, 2002, the disclosures of which are expressly incorporated herein by reference.

FIELD OF THE INVENTION

The present invention is directed to an engagement or carrier element, to a method for producing an engagement or carrier element, as well as to a mandrel. The engagement or carrier element is used to transmit torque and has a cutting edge with cutting faces.

BACKGROUND OF THE INVENTION

Mandrels for use in seating rolls of material, in particular for seating paper rolls, are generally known in the paper and printing industry. Such mandrels are employed at the roll changers of web-fed rotary printing presses to rotatably seat or support the rolls of material, from which the paper to be imprinted is drawn off, during operation of the web-fed rotary printing press. A so-called flying roll change is often performed at such roll changers. In this connection, a flying roll change means that gluing of a leading end of a fresh roll, to a tensioned web of an exhausting paper web, can be performed while the tensioned, exhausting paper web continues its running off. Only fractions of seconds are available for performing such a flying roll change, during which time the tension, tensile stress and shearing strain must be exactly maintained.

To be able to perform a flying roll change, the fresh paper web roll must be accelerated in such a way that its circumferential speed corresponds exactly to the linear speed of the paper web which is running off. The torque required for accelerating the fresh roll of the web of material is transmitted to that roll by appropriately suitable drive systems. In this connection, so-called belt-drive systems are known, for example, wherein drive belts are brought into contact with the circumference of the fresh roll. These belt-drive systems accelerate the fresh roll by the use of an appropriate frictional connection between the belts and the roll outer surface. Moreover, so-called cardan drives are known, wherein the required drive torque is transmitted to receiver elements, which receiver elements come into contact with the roll of material on both of its sides.

A mandrel is known, for example, from EP 0 453 800 B1. With this mandrel, radially drivable, spreading cheeks are provided at the receiver element which cheeks, after the receiver element has been arranged in a core of the roll of material, can be moved apart to make a frictional connection between the roll of material and the mandrel. It is not inconceivable, in connection with such mandrels with radially spreading cheeks that, because of the high inherent weight of the roll and thus because of the resultant high moments of acceleration, the roll of material will slide over, or with respect to the clamping cheeks during roll acceleration or braking. This undesirable slippage can cause irregularities in the movement progress of the roll. Furthermore, the interior surface of the core of the roll of material can be damaged by such a sliding of the spreading cheeks with respect to the core, so that a secure fastening of the roll of material on the mandrel is no longer provided.

DD 82615 describes a clamping device for winding tubes. Several clamping pins, with knife-like cutting edges, are pressed into the winding tube.

DE 28 32 361 A1, DE 21 00 746 A, DE-PS 972 578, GB 2 293 225 A and DE 73 17 470 U all disclose mandrels with engagement elements which engage the web of material by positive contact.

SUMMARY OF THE INVENTION

The object of the present invention is directed to providing an engagement element, to a method for producing such an engagement element, as well as to a mandrel including such an engagement or carrier element.

In accordance with the present invention, these objects are attained by the provision of an engagement element for use in transmitting torque and which engagement element has a cutting edge with cutting faces that cross each other and that form a wedge angle. The engagement element penetrates into the object to be driven. The cutting faces may each have a convex shape. The engagement element can be fabricated by forming a first one of the cutting faces into an end of a profiled rod, by then rotating the rod by 180° about its center axis and by then forming the second one of the cutting faces. A mandrel for supporting a roll of material can include the engagement element. The mandrel can include a roll core stripping switching arrangement.

The advantages to be realized by the present invention consist, in particular, that by the arrangement of appropriately suitable engagement elements, it is possible to make a positive connection between the roll of material and the mandrel. Based on this positive connection, a considerably more dependable transmission of a driving torque from the mandrel to the roll of material is assured. Furthermore, in embodiments wherein non-positively or frictionally connected engagement elements are not provided in addition to the positively connected engagement elements, it is possible, in such embodiments, to omit the mechanically elaborate drive mechanisms that are typically provided for adjusting such non-positively or frictionally connected engagement elements. In this connection, it is, of course, also possible to combine the engagement elements acting in a positively connected manner with generally known, non-positively or frictionally connected acting engagement elements, such as, for example, spreading cheeks.

In accordance with preferred embodiments of the present invention, the engagement elements are arranged on the mandrel in such a way that they can be brought into engagement with an end or front face of a roll of material and will extend substantially parallel to the longitudinal axis of the roll of material. By the use of this configuration, it is possible to achieve that, by the displacement movement of the mandrel, in the course of putting the roll of material on the shaft, and during which movement the receiver element is axially introduced into the core of the roll of material, the engagement elements are pressed, in a positively connected manner, into the front or end face of the roll of material without the need for, or use of an additional displacement drive mechanism. A separate displacement drive for adjusting the engagement elements, which act in a positively connected manner, can then be omitted.

A particularly uniform force introduction from the mandrel into the roll of material is assured if at least three engagement elements are provided, which three engagement elements are arranged, in a circular shape, around the center of the receiver element. The number of engagement elements can be increased to correspond to the level of the forces to be transmitted.

To provide a positive connection between the engagement element and the roll of material, appropriately suitable receivers can be provided on the roll of material. The engagement elements of the mandrel can be brought into engagement with these receivers when the roll of material is put on the shaft. However, the provision of such receivers on the roll of material requires an additional production outlay. This additional production outlay can be avoided if a cutting edge is provided on the engagement element. By the provision and use of this cutting edge, the engagement element can penetrate the material of the roll of material, which may be, for example, the wall of a cardboard tube, with a relatively low pressing force. At the same time, tearing or ripping of the material of the roll of material is prevented because of the provision of the cutting edge.

BRIEF DESCRIPTION OF THE DRAWINGS

A preferred embodiment of the invention in accordance with the present invention is represented in the drawings and will be described in greater detail in what follows.

Shown are in.

DESCRIPTION OF THE PREFERRED EMBODIMENT

Figure 1:
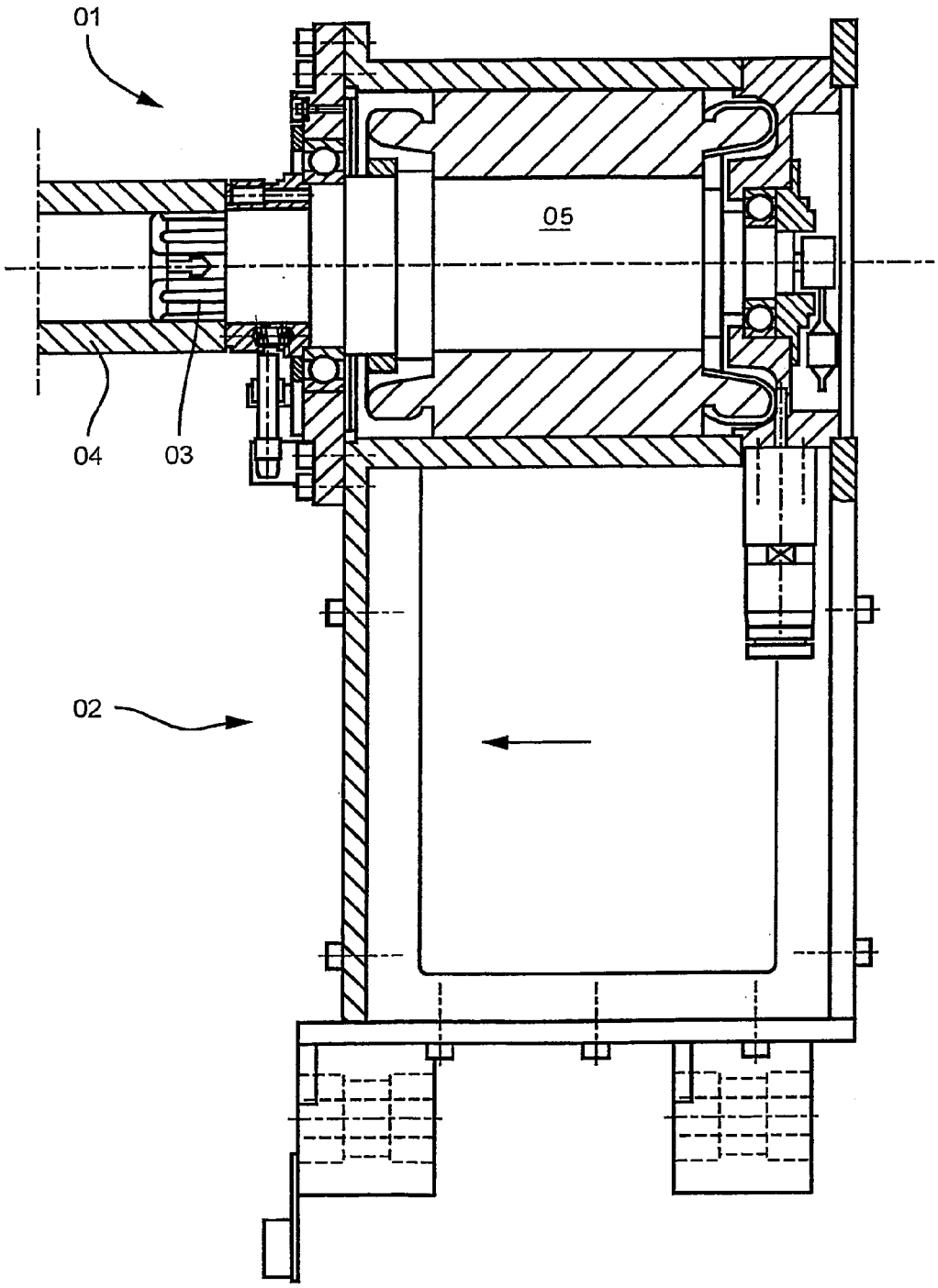
FIG. 1, a cross-sectional view of a mandrel in accordance with the present invention, in FIG. 2, an enlarged view of a portion of the mandrel which is depicted in FIG. 1, in FIG. 3, an enlarged view, partly in cross-section of a portion of the mandrel in accordance with FIG. 2, in FIG. 4, a first side elevation view of an engagement element for use with a mandrel in accordance with FIG. 1, in FIG. 5, cross-sectional views of a cutting edge of the engagement element in accordance with FIG. 4 and taken along the section lines B-B and C-C, respectively of FIG. 4, in FIG. 6, a second side elevation view of the engagement element in accordance with FIG. 4, in FIG. 7, a partial cross-sectional view of a cutting edge of the engagement element in accordance with FIG. 6 and taken along the section line A-A of FIG. 6, in FIG. 8, a schematic presentation of a device for producing the engagement element in accordance with FIG. 3 in a side elevation view, and in FIG. 9, a front plan view of the device in accordance with FIG. 8.

A mandrel, generally at 01 and represented in FIG. 1, is fastened to a frame of a roll changer 02 in a web-fed rotary printing press. A rotationally symmetrical receiver element 03 is provided on the mandrel 01, which receiver element 03 can come into contact with an interior circumference of a roll 04 of material. In particular, the receiver element 03 can come into contact with the interior circumference of a cardboard tube or roll 04 on which a web of material, and in particular, on which tube or roll 04 a paper web has been wound. The receiver element 03 is rotatorily seated in rolling bearings and can be rotatorily driven by the use of an electrical drive mechanism 05, as seen in FIG. 1. When placing the roll 04, used for the support of a web of material, on the shaft, two generally identical, opposing mandrels 01 of the roll changer 02, only one of which mandrels 01 is represented in FIG. 1, are moved toward each other in the axial direction. The receiver elements 03 are thus introduced into the hollow core from the direction of the front or end face of the roll of material or the tube 04 that is used for support of material such as a paper web.

Figure 2:
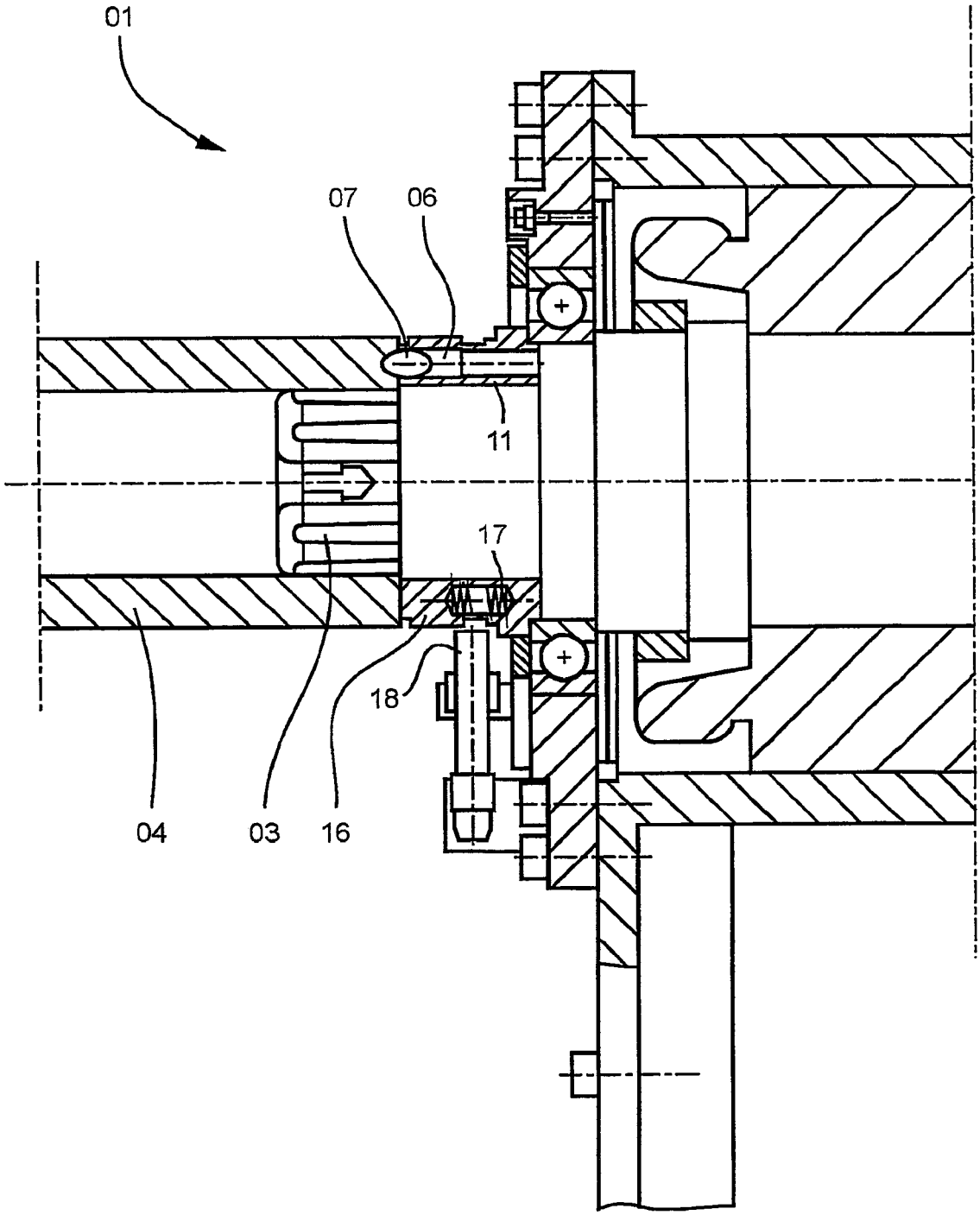

In FIG. 2 there is depicted an enlarged view of the mandrel 01 following the placement of the roll 04 of material on the receiving element 03. Several engagement elements 06 are arranged, distributed in a circle concentrically around the center of the receiver element 03, on the mandrel 01. Only one of these plural engagement elements 06 is represented in FIG. 2. An end of each engagement element 06, pointing toward an end face of the roll or tube 04 used to support the web of material, has a cutting edge 07 which cutting edge 7, in the course of the two opposing mandrels 01 moving together, enters into the end face of the roll of material 04 or into the tube 04 that supports a web of material and in this way makes a positive connection between the roll 04 of material or the tube and the mandrel 01.

The structure of a representative one of the engagement elements 06 is represented, by way of example, in FIGS. 4 to 7. A cutting edge 07 of the engagement element 06 is defined by two cutting faces 08 and 09 which intersect each other, and which enclose a wedge angle $\alpha$ of 25° to 45°, and in particular of approximately 34°. Both of the two cutting faces 08 and 09 each have a convex shape, since they are being constituted by sections of generated cylinder surfaces which cross each other. The convex curvature of one of the cutting faces 08 and 09 can be seen, in particular, in the cross section taken along the section lines A-A of FIG. 6 and represented in FIG. 7. By the use of this type of configuration of the engagement elements 06, it is achieved that, in the course of a torque transmission, the tip of the engagement element 06 is stressed by a bending stress which is substantially constant over the cross section. This stress distribution is something which permits an optimal utilization of the material.

The wedge or cutting angle $\alpha_1$ which is an acute angle $\alpha_1$ during the initial penetration of the cutting edge 07 into the roll 04 of material, makes a transition, in the course of increasing penetration depth, into an obtuse angle $\alpha_2$ as far as the round cross section of engagement element 06. The wedge angle $\alpha$ becomes continuously larger along the cutting edge 07. This favors the displacement of the material, in the course of an increasing engagement element cross section.

The core material, at the penetration point of the engagement element 06, is initially cut effectively and without damaging further cardboard layers because of the initial small width of the tip of the cutting end of the engagement element 06. In this context, see the section lines B-B of FIG. 5. With increasing penetration depth of the cutting edge 07, the core material is appropriately displaced. In this regard see section line C-C shown in FIG. 5.

The angle $\alpha_1$ continuously increases to the angle $\alpha_2$. Because of this, the penetration depth of the cutting edge 07 of the engagement element 06 into the roll 04 of material is minimized.

The several engagement elements 06, only one of which is depicted in FIG. 2, are fastened on the mandrel 01 by the provision of a clamping ring 11, as is also seen in FIG. 2. A circular flange 12 has been formed on, or attached to an end of the engagement element 06 that is located opposite the cutting edge 07. Flange 12 secures the engagement element 06 against slipping out of the clamping ring 11. Furthermore, two tool engagement faces 13 or 14 have been formed on a shank of the engagement element 06 intermediate cutting edge 07 and flange 12, and against which faces an assembly tool can be brought to act.

Figure 3:
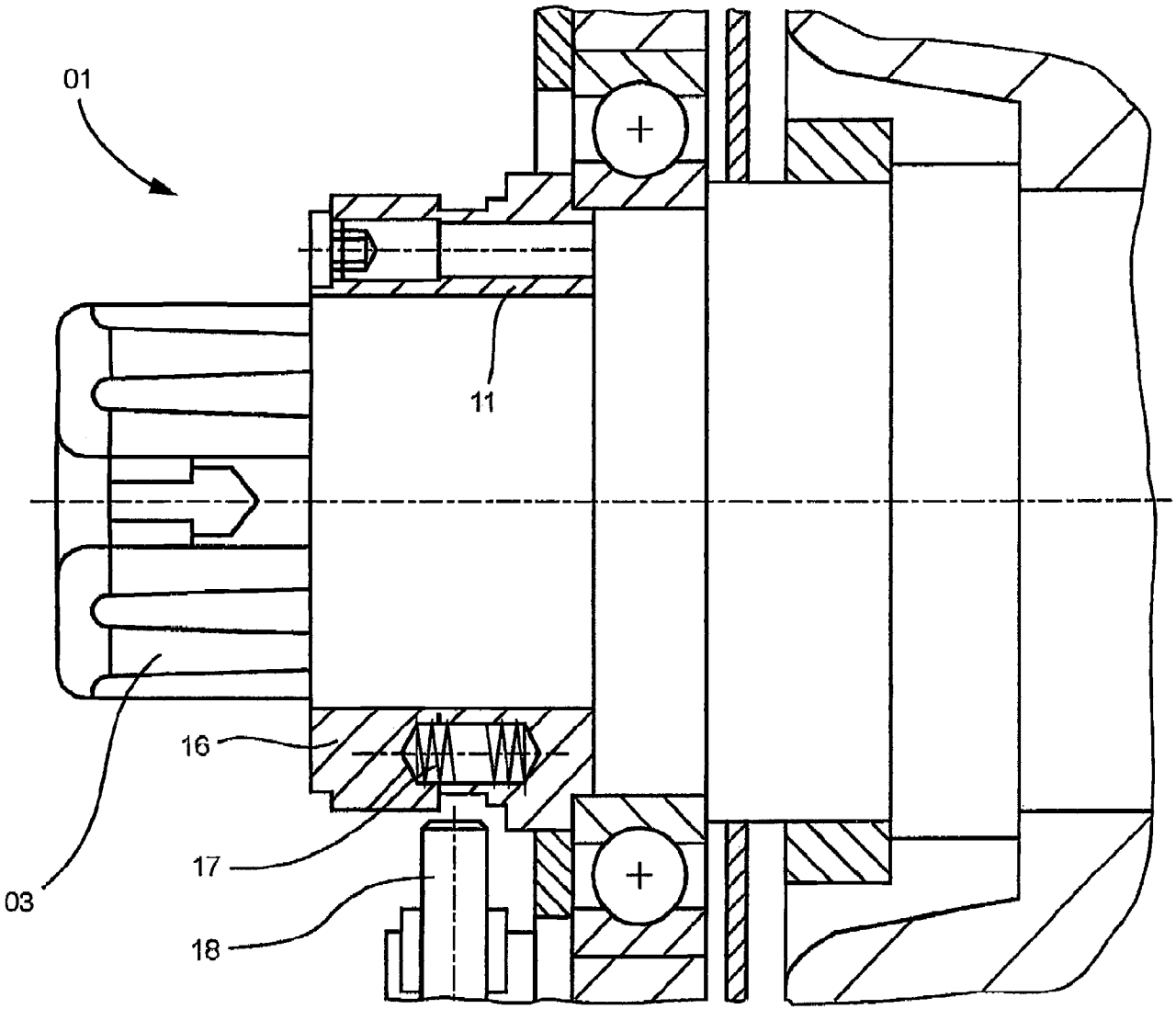
Figure 4:
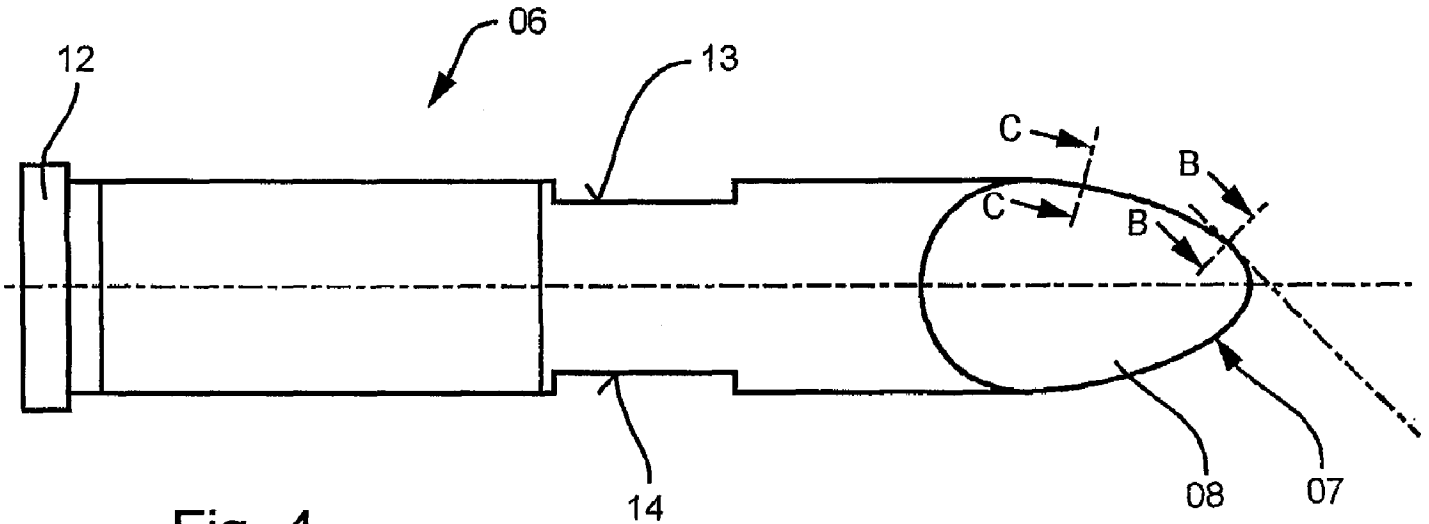
Figure 5:
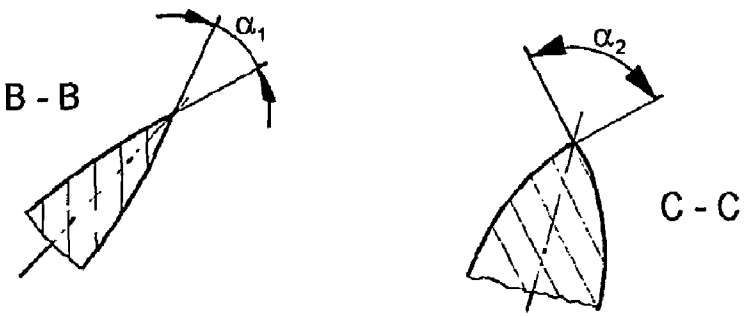
Figures 6, 7:
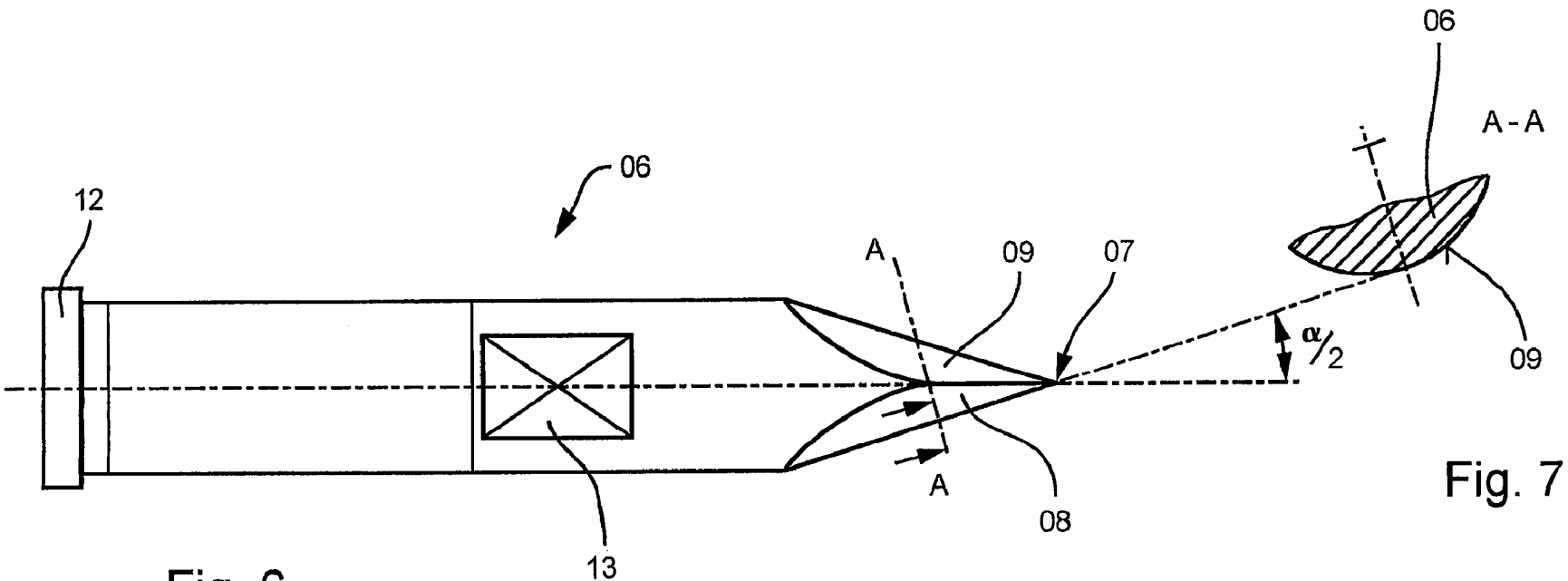

As shown in FIG. 2, and in the enlarged view in FIG. 3, the engagement elements 06 pass through a switching arrangement 16 which is embodied in the manner of a lift-switching ring 16, which can be brought into flat contact with the front or end face of roll 04 of material or tube 04. In each of FIGS. 2 and 3, the switching arrangement 16 is represented in a clamping position which it assumes following the placement of the tube or the roll 04 of material on the shaft of the mandrel 01. The switching arrangement 16 is seated in an axially displaceable manner and is supported on the clamping ring 11 by several springs 17, for example by several helical springs 17. In the course of placing the tube or the roll 04 of material on the shaft, its end face is pressed against the switching arrangement 16 and is clamped by the helical springs 17. The spring constant of the helical springs 17 has been selected to be large enough so that the spring force is sufficient to strip the tube or the roll 04 of material off the engagement elements 06 when the mandrels 01 are moved apart. This means that by displacing the switching arrangement 16 out of the clamping position represented in FIGS. 2 and 3, and into an advanced or extended ejection position, the roll 04 of material is taken out of positive engagement with the engagement elements 06 and can therefore be easily removed from the mandrel 01.

A contactless, operating sensor 18 is provided on the mandrel 01, by the use of which sensor 18 the position of the switching arrangement 16 can be detected. In other words, by evaluating the output signal from the sensor 18 it is possible to determine, in a control device of the installation, whether the switching arrangement 16 is in its clamping position or in its ejection position. In other words, it is possible to detect, by this signal evaluation, whether or not a roll 04 of material has been placed on the shaft of the mandrel 01.

Figure 8:
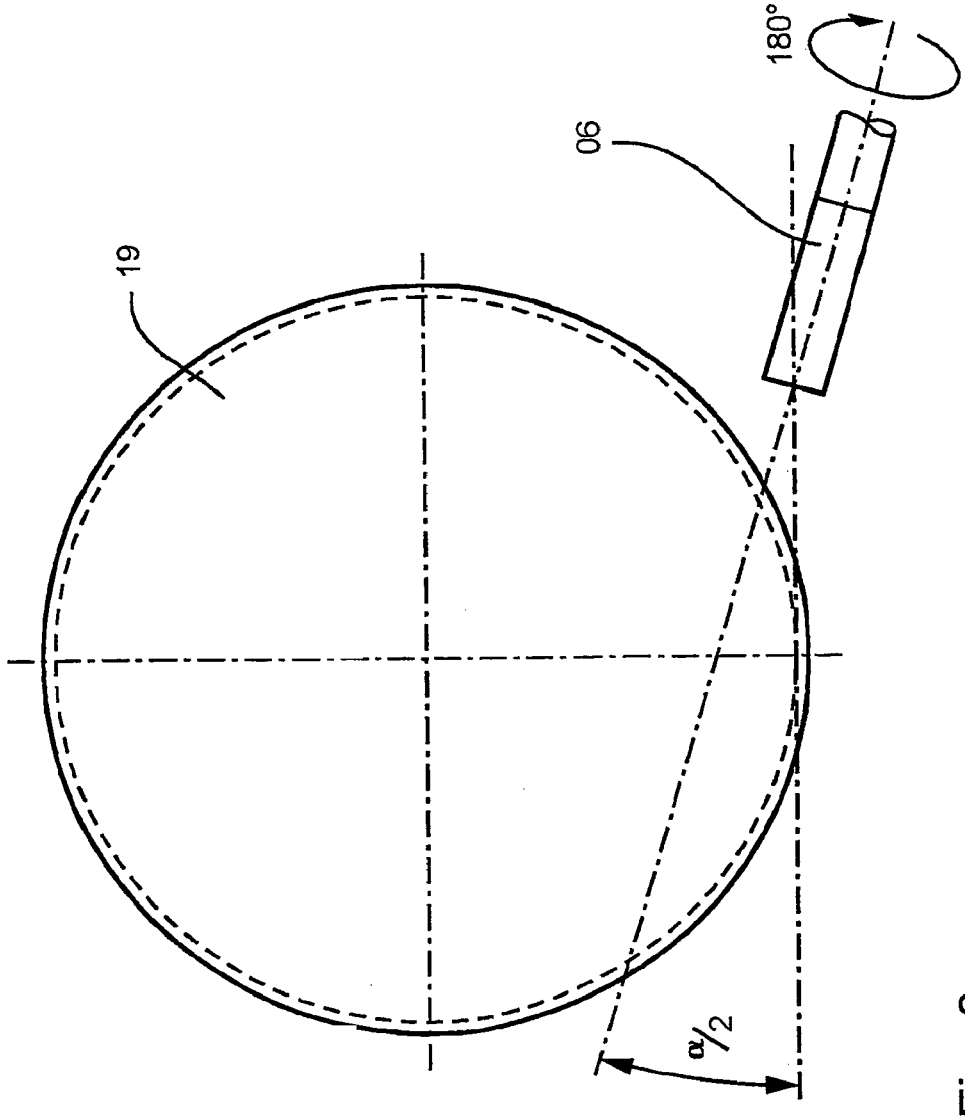

A device for producing an engagement element 06, in accordance with the present invention, is schematically represented in FIG. 8. In a first process step, a first convex cutting face 08 of the engagement element 06 is cut into an end of a profiled rod by the use of a form-grinding wheel 19. In the course of this process, the end of the profiled rod is placed into engagement with the form-grinding wheel 19 at an acute angle $\alpha/2$, which corresponds to half the wedge angle $\alpha$. As soon as the first cutting face 08 has been formed on the end of the engagement element 06, the profiled rod is rotated by 180° and processing is analogously repeated on the opposite side of the end of the engagement element 06, so that the second cutting face 09 and the cutting edge 07 are formed into the engagement element 06.

Figure 9:
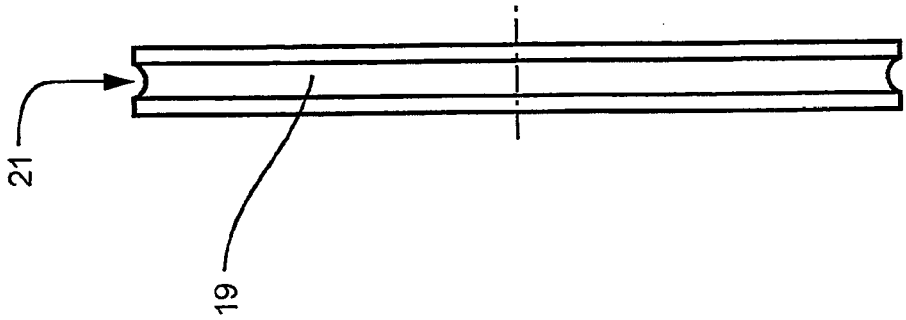

The concave circular profile 21 of the form-grinding wheel 19 can be seen most clearly in FIG. 9. Because of this profile, the production of cutting faces 08 and 09, which cutting faces 08 and 09 have the shape of a section of a generated cylinder surface, is possible through the use of the form grinding wheel 14.

While preferred embodiments of a carrier or engagement element, a method for making an engagement element, and a mandrel including such an engagement element have been set forth fully and completely hereinabove, it will be apparent to one of skill in the art that various changes in, for example, the size of the mandrel, the number of engagement elements positioned about the mandrel, and the like could be made without departing from the true spirit and scope of the present invention which is accordingly to be limited only by the appended claims.

What is claimed is:

1. A mandrel assembly adapted to transmit torque to an object to be driven, said mandrel assembly comprising:
- a mandrel adapted to seat an object to be driven;
- an engagement element arranged in said mandrel;
- a cutting edge on said engagement element;
- first and second cutting faces on said engagement element and intersecting each other to define said cutting edge on said engagement element;
- a wedge angle formed by said first and second intersecting cutting faces; and
- a longitudinal direction of said engagement element, said wedge angle increasing along said cutting edge in said longitudinal direction in which said engagement element penetrates into an object to be driven.

2. The mandrel assembly of claim 1 further including a receiver element in said mandrel and adapted to engage an inner circumference of an object to be driven.

3. The mandrel assembly of claim 2 further including at least three engagement elements on said mandrel and arranged in a circle around a center of said receiver element.

4. The mandrel assembly of claim 1 further including:
- a roll of material having a longitudinal axis and wherein said engagement element extends in said longitudinal axis of said roll of material.

5. The mandrel assembly of claim 4 further including a roll of material end face, said engagement element adapted to positively engage said roll of material end face.

6. The mandrel assembly of claim 1 wherein said wedge angle is between 25° and 45°.

7. The mandrel assembly of claim 6 wherein said wedge angle is 34°.

8. The mandrel assembly of claim 1 wherein each of said cutting faces has a convex shape.

9. The mandrel assembly of claim 1 wherein each of said cutting faces is a section of a generated cylinder surface.

10. The mandrel assembly of claim 1 further including an outer surface on said engagement element with at least one tool engagement face on said outer surface and adapted to be engagable by a tool.

11. A mandrel assembly adapted to transmit torque to an object to be driven, said mandrel assembly comprising:
- a mandrel adapted to seat an object to be driven;
- an engagement element arranged in said mandrel;
- a cutting edge on said engagement element;
- first and second cutting faces on said engagement element and intersecting each other to define said engagement cutting edge on said engagement element; and
- a wedge angle formed by said cutting faces, said engagement element being adapted to penetrate into an object to be driven, said cutting faces each having a convex shape.

12. The mandrel assembly of claim 11 further including a receiver element in said mandrel and adapted to engage an inner circumference of an object to be driven.

13. The mandrel assembly of claim 12 further including at least three engagement elements on said mandrel and arranged in a circle around a center of said receiver element.

14. The mandrel assembly of claim 11 further including:
- a roll of material having a longitudinal axis and wherein said engagement element extends in a direction of said roll of material longitudinal axis.

15. The mandrel assembly of claim 14 further including a roll of material end face, said engagement element adapted to positively engage said roll of material end face.

16. The mandrel assembly of claim 11 wherein said wedge angle is between 25° and 45°.

17. The engagement element of claim 16 wherein said wedge angle is 34°.

18. The mandrel assembly of claim 11 wherein each of said cutting faces is a section of a generated cylinder surface.

19. The mandrel assembly of claim 11 further including an outer surface on said engagement element with at least one tool engagement face on said outer surface and adapted to be engagable by a tool.

20. A mandrel assembly adapted to seat a roll of material comprising:

a receiver element engagable with an inner circumference of said roll of material;

an engagement element adapted to transmit a torque between said mandrel assembly and said roll of material;

a cutting edge on said engagement element;

a switching arrangement adapted to strip said roll of material off said engagement element, said engagement element passing through said switching element;

means for displacing said switching arrangement in an axial direction of said roll of material between an ejection position and a clamped position;

an electrical drive mechanism including a rotor, said receiver element, said engagement element and said switching arrangement being arranged coaxially in relation to said rotor of said electrical drive mechanism; and an end face of said roll of material, said engagement element adapted to positively engage said end face of said roll of material.

21. The mandrel assembly of claim 20 further including a sensor adapted to detect when said switching arrangement is arranged in selectively one of said ejection position and said clamped position.

22. The mandrel assembly of claim 20 wherein said switching arrangement is supported on said mandrel by at least one energy accumulator whereby said switching arrangement is moveable from said clamping position to said ejection position by said energy accumulator upon separation of said roll of material from said mandrel.

23. The mandrel assembly of claim 22 wherein said energy accumulator is a helical spring.

24. The mandrel assembly of claim 20 wherein said switching arrangement is a switching ring.

* * * * *

UNITED STATES PATENT AND TRADEMARK OFFICE

CERTIFICATE OF CORRECTION

PATENT NO. : 7,258,300 B2
APPLICATION NO. : 10/514553
DATED : August 21, 2007
INVENTOR(S) : Karl Richard Rosch It is certified that error appears in the above-identified patent and that said Letters Patent is hereby corrected as shown below:

Claim 11, line 7, after "said," delete "engagement"

Signed and Sealed this

Twentieth Day of November, 2007

JON W. DUDAS
*Director of the United States Patent and Trademark Office*